US012130092B2

(12) United States Patent
Choi et al.

(10) Patent No.: US 12,130,092 B2
(45) Date of Patent: Oct. 29, 2024

(54) HEAT TRANSFER PIPE AND HEAT EXCHANGER FOR CHILLER

(71) Applicant: LG ELECTRONICS INC., Seoul (KR)

(72) Inventors: Jiwon Choi, Seoul (KR); Hongseong Kim, Seoul (KR); Yohan Lee, Seoul (KR); Hanchoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 355 days.

(21) Appl. No.: 17/425,009

(22) PCT Filed: Jan. 28, 2020

(86) PCT No.: PCT/KR2020/001253

§ 371 (c)(1),
(2) Date: Jul. 22, 2021

(87) PCT Pub. No.: WO2020/159175

PCT Pub. Date: Aug. 6, 2020

(65) Prior Publication Data

US 2022/0082338 A1 Mar. 17, 2022

(30) Foreign Application Priority Data

Jan. 28, 2019 (KR) ..... 10-2019-0010677

(51) Int. Cl.
*F28F 1/40* (2006.01)
*F28D 7/16* (2006.01)
(Continued)

(52) U.S. Cl.
CPC ..... *F28F 1/40* (2013.01); *F28D 7/16* (2013.01); *F28F 13/12* (2013.01); *F28D 2021/0071* (2013.01)

(58) Field of Classification Search
CPC .... F28F 1/40; F28F 13/12; F28D 7/16; F28D 2021/0071
See application file for complete search history.

(56) References Cited

U.S. PATENT DOCUMENTS 813,918 A * 2/1906 Schmitz ..... F28D 7/103 428/596
2,775,683 A * 12/1956 Kleist ..... F28D 7/106 392/397

(Continued)

FOREIGN PATENT DOCUMENTS

JP H05-164483 6/1993
JP 10-054687 2/1998

(Continued)

OTHER PUBLICATIONS

International Search Report dated Jun. 1, 2020 issued in Application No. PCT/KR2020/001253.

(Continued)

*Primary Examiner* — Raheena R Malik
(74) *Attorney, Agent, or Firm* — KED & ASSOCIATES, LLP

(57) ABSTRACT

A heat transfer pipe includes an outer pipe having a space therein and extending a first direction, a core disposed in the space inside the outer pipe, defining a refrigerant flow space through which a refrigerant flows between an inner surface of the outer pipe and the core, and extending in the first direction, and a resistor disposed in the refrigerant flow space and having a spiral shape with a central axis disposed to be parallel to the first direction.

7 Claims, 9 Drawing Sheets

(51) Int. Cl.
*F28F 13/12* (2006.01)
*F28D 21/00* (2006.01)

(56) References Cited

U.S. PATENT DOCUMENTS 3,232,341 A * 2/1966 Woodworth ..... F28B 1/00 165/146
3,235,003 A * 2/1966 Smith ..... F01N 13/18 181/239
3,407,871 A * 10/1968 Penney ..... F28D 7/16 159/DIG. 15
3,648,754 A * 3/1972 Sephton ..... B01D 63/06 210/321.89
3,768,660 A * 10/1973 Block ..... B01D 63/06 210/321.87
3,835,294 A * 9/1974 Krohn ..... F24H 1/121 392/494
3,846,616 A * 11/1974 Beck ..... H05B 3/50 392/491
3,922,220 A * 11/1975 Middleman ..... B01D 63/06 210/321.78
4,583,585 A * 4/1986 Estienne ..... F28G 1/12 165/95
4,633,939 A * 1/1987 Granetzke ..... F28F 13/12 165/76
5,212,942 A * 5/1993 Malohn ..... F28F 13/12 60/39.182
5,466,384 A * 11/1995 Prevost ..... B01D 29/902 210/512.3
5,488,836 A * 2/1996 Laude-Bousquet ..... F25C 1/14 165/92
8,033,327 B2 * 10/2011 Van Hees ..... F28F 13/12 165/172
8,162,040 B2 * 4/2012 Briselden ..... F23L 15/04 165/142
8,180,207 B2 * 5/2012 Shirai ..... F24H 9/2028 392/491
8,225,848 B2 * 7/2012 Cottard ..... F28F 19/008 165/95
9,702,351 B2 * 7/2017 Steinhour ..... F04B 53/08
11,112,188 B1 * 9/2021 Ballew ..... F28D 1/0213
11,333,451 B2 * 5/2022 Livni ..... F28D 7/0083

FOREIGN PATENT DOCUMENTS

JP 10-267578 10/1998
JP 2003-307396 10/2003
JP 2018-080843 5/2018
KR 10-1084477 11/2011
KR 10-2014-0110492 9/2014
KR 10-1519909 5/2015

OTHER PUBLICATIONS

Korean Notice of Allowance dated Oct. 15, 2020 issued in Application No. 10-2019-0010677.
German Office Action dated Apr. 4, 2022 issued in Application No. 112020000551.8.

* cited by examiner

HEAT TRANSFER PIPE AND HEAT EXCHANGER FOR CHILLER

CROSS-REFERENCE TO RELATED PATENT APPLICATIONS

This application is a U.S. National Stage Application under 35 U.S.C. § 371 of PCT Application No. PCT/KR2020/001253, filed Jan. 28, 2020, which claims priority to Korean Patent Application No. 10-2019-0010677, filed Jan. 28, 2019, whose entire disclosures are hereby incorporated by reference.

BACKGROUND OF THE DISCLOSURE

Field of the disclosure

The present disclosure relates to a heat transfer pipe and a heat exchanger for a chiller.

Related Art

In general, in a chiller system, cold water is supplied to a cold-water demander, and heat exchange is performed between a refrigerant circulating in a refrigeration system and cold water circulating between the cold-water demander and the refrigeration system to cool the cold water. The chiller system is a large-capacity facility and may be installed in a large-scale building or the like.

A chiller system of the related art is disclosed in Korean Patent Registration No. 10-1084477. In the prior art, a heat transfer pipe is used to perform exchange heat between two refrigerants. The heat transfer pipe has a space, through which a first refrigerant passes, inside the heat transfer piper, an outer surface of the heat transfer pipe is in contact with a second refrigerant, and thus, the exchange heat is performed between the two refrigerants.

Such a general heat pipe has a problem in that when a fluid passes into the inside of the heat transfer pipe, the fluid, which is a liquid or gas, passes quickly without contacting 100% or more of an inner surface of the heat transfer pipe evenly, and thus, the transfer with the external second refrigerant is reduced.

In addition, since the fluid moves at a constant speed without interference of an obstacle when the fluid passes through the heat transfer pipe, the fluid moves in a state where heat transfer of the fluid is not completely achieved with the surface. Accordingly, sufficient heat exchange is not achieved, and when the fluid moves, a portion of the fluid passes through the inside of the heat transfer pipe as it is without generating a flow, and thus, the heat of the fluid cannot be effectively transferred.

In particular, when R-134a, which is a refrigerant for the existing chiller, is changed to R1233zd, which is an eco-friendly refrigerant (non-flammable, non-toxic), there is a problem that the performance of the heat transfer pipe is greatly reduced (40%).

That is, there is a problem that a heat transfer pipe having very excellent heat exchange efficiency is required to use an eco-friendly refrigerant.

SUMMARY

An object of the present disclosure is to provide a heat transfer pipe and a chiller system in which efficiency is not reduced while using an eco-friendly refrigerant.

Another object of the present disclosure is to provide a heat transfer pipe that is easily manufactured and maximizes heat transfer efficiency in the same pipe diameter.

Objects of the present disclosure are not limited to the objects mentioned above, and other objects not mentioned will be clearly understood by those skilled in the art from the following description.

In order to achieve the above objects, in the present disclosure, a core having a reduced pipe diameter and a resistor for generating turbulence and vortex are provided in an outer pipe.

Specifically, according to an aspect of the present disclosure, there is provided a heat transfer pipe including an outer pipe having a space therein and extending a first direction, a core disposed in the space inside the outer pipe, defining a refrigerant flow space through which a refrigerant flows between an inner surface of the outer pipe and the core, and extending in the first direction, and a resistor disposed in the refrigerant flow space and having a spiral shape with a central axis disposed to be parallel to the first direction.

A cross section of the resistor may include at least one of a circle, an ellipse, and a polygon.

A pitch of a spiral of the resistor may be 50% to 150% of a diameter of the outer pipe.

A central axis of the spiral of the resistor may be disposed to overlap the core.

A cross section of the resistor may be a rectangle having a long side and a short side, and a length of the long side may be 10% to 50% of a diameter of the outer pipe.

The heat transfer pipe may further include a plurality of guide holes passing through the resistor.

The heat transfer pipe may further include a plurality of guide grooves formed on an inner surface of the outer pipe.

The heat transfer pipe may further include a guide groove having an inner surface formed to be recessed on the outer pipe and a spiral shape with a central axis disposed to be parallel to the first direction.

A depth of the guide groove may be 1% to 4% of a diameter of the outer pipe.

The core may be disposed at a center of the outer pipe.

A cross-sectional shape of the core may be circular.

A diameter of the core may be 15% to 50% of a diameter of the outer pipe.

The heat transfer pipe may further include a plurality of arms coupling the core to the outer pipe.

According to another aspect of the present disclosure, there is provided a heat exchanger for a chiller including a case having a heat exchange space, a first refrigerant supply pipe coupled to the case and configured to supply a first refrigerant to the heat exchange space, a first refrigerant discharge pipe coupled to the case so that the first refrigerant in the heat exchange space is discharged through the first refrigerant discharge pipe, and a plurality of heat transfer pipes disposed in the heat exchange space of the case so that a second refrigerant exchanging heat with the first refrigerant flows through the heat transfer pipes, in which the heat transfer pipe includes an outer pipe having a space therein and extending in a first direction, a core disposed in an internal space of the outer pipe, defining a refrigerant flow space through which the refrigerant flows between an inner surface of the outer pipe and the core, and extending in the first direction, and a resistor disposed in the refrigerant flow space and having a spiral shape with a central axis disposed to be parallel to the first direction.

A central axis of a spiral of the resistor may be disposed to overlap the core.

The heat transfer pipe for a chiller may further include a plurality of guide holes passing through the resistor.

The heat transfer pipe for a chiller may further include a plurality of guide grooves formed on an inner surface of the outer pipe.

The core may be disposed at a center of the outer pipe.

A cross-sectional shape of the core may be circular.

The heat transfer pipe for a chiller may further include a plurality of arms coupling the core to the outer pipe.

The details of other embodiments are included in the detailed description and drawings.

ADVANTAGEOUS EFFECTS

According to a heat transfer pipe and a heat transfer pipe for a chiller of the present disclosure, there are one or more of the following effects.

First, according to the present disclosure, a core is disposed at a center of the heat transfer pipe, and thus, it is possible to prevent a refrigerant passing through the center of the heat transfer pipe from not exchanging heat with a refrigerant outside the heat transfer pipe, and thus, it is possible to improve heat exchange efficiency.

Second, according to the present disclosure, a speed of the refrigerant passing through an outer region inside the heat transfer pipe is reduced, and thus, turbulence and vortex are generated. Therefore, it is possible to improve the heat exchange time and efficiency with the refrigerant outside the heat transfer pipe.

Third, the present disclosure has a structure which is simple and easily manufactured.

Fourth, according to the present disclosure, even when an eco-friendly refrigerant is used, it is possible to increase efficiency of a chiller.

Effects of the present disclosure are not limited to the effects mentioned above, and other effects not mentioned will be clearly understood by those skilled in the art from the description of the claims.

DESCRIPTION OF EXEMPLARY EMBODIMENTS

Figure 1:
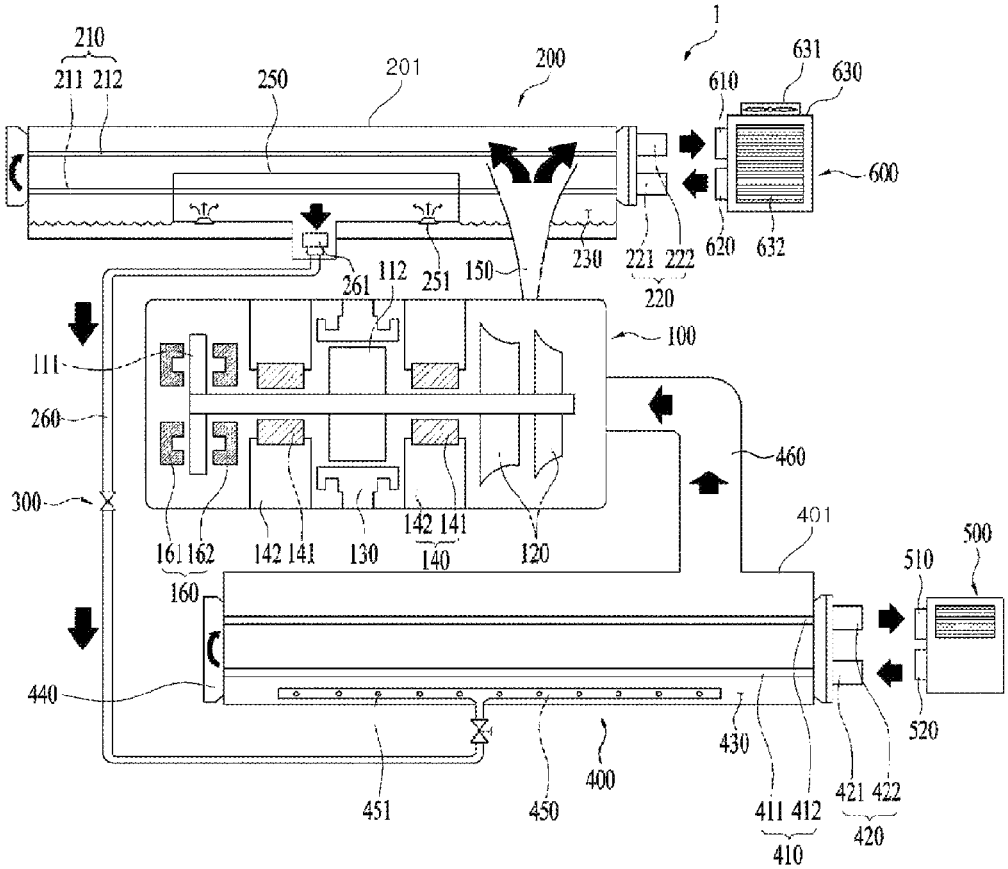
FIG. 1 illustrates a chiller system in one embodiment of the present disclosure.

Advantages and features of the present disclosure and methods of achieving them will become apparent with reference to embodiments described below in detail in conjunction with the accompanying drawings. However, the present disclosure is not limited to the embodiments disclosed below, but may be implemented in various different forms. That is, only the present embodiments are provided to ensure that the disclosure of the present disclosure is complete, and to fully inform those of ordinary skill in the art to which the present disclosure belongs, and the present disclosure is only defined by the scope of the claims. Similar reference numerals refer to similar elements throughout.

Spatially relative terms "below", "beneath", "lower", "above", "upper", or the like may be used to easily describe the correlation between one component and other components as illustrated in the drawings. Spatially relative terms should be understood as terms including different directions of components in use or operation in addition to directions illustrated in the drawings. For example, when a component illustrated in the drawing is turned over, a component described as "beneath" or "beneath" of another component may be placed "above" of the other component. Accordingly, the exemplary term "below" may include both directions below and above. Components may also be oriented in other directions, and thus, spatially relative terms may be interpreted according to orientation.

Terms used herein are for the purpose of describing the embodiments and are not intended to limit the present disclosure. In this specification, the singular also includes the plural, unless specifically stated otherwise in the phrase. As used herein, "comprises" and/or "comprising" means that a referenced component and step and/or action include the presence or addition of one or more other components, steps and/or actions.

Unless otherwise defined, all terms (including technical and scientific terms) used herein may be used with the meaning commonly understood by those of ordinary skill in the art to which the present disclosure belongs. In addition, terms defined in a commonly used dictionary are not to be interpreted ideally or excessively unless clearly defined in particular.

In the drawings, a thickness or size of each component is exaggerated, omitted, or schematically illustrated for convenience and clarity of description. Moreover, the size and area of each component do not fully reflect an actual size or area.

Hereinafter, a preferred embodiment of the present disclosure will be described with reference to the accompanying drawings.

Hereinafter, the present disclosure will be described with reference to the drawings for explaining a chiller system according to embodiments of the present disclosure.

FIG. 1 illustrates a chiller system of the present disclosure. Meanwhile, a compressor 100 according to one embodiment of the present disclosure not only functions as a portion of the chiller system, but may also be included in an air conditioner, and may be included in any device that compresses a gaseous material.

Referring to FIG. 1, a chiller system 1 according to one embodiment of the present disclosure includes a compressor 100 that compresses a refrigerant, a condenser 200 that performs heat exchange between the refrigerant compressed in the compressor 100 and cooling water to condense the refrigerant, an expander 300 that expands the refrigerant condensed in the condenser 200, and an evaporator 400 that performs heat exchange between the refrigerant expanded in the expander 300 and cold water to evaporate the refrigerant and cool the cold water.

In addition, the chiller system 1 according to one embodiment of the present disclosure further includes a cooling water unit 600 that heats the cooling water through the heat exchange between the refrigerant compressed in the condenser 200 and the cooling water, and an air conditioning unit 500 that cools the cold water through the heat exchange between the refrigerant expanded in the evaporator 400 and the cold water.

The condenser 200 provides a place for performing heat exchange between a high-pressure refrigerant compressed in the compressor 100 and the cooling water introduced from the cooling water unit 600. The high-pressure refrigerant is condensed through heat exchange with the cooling water.

The condenser 200 may be configured as a shell-pipe type heat exchanger. Specifically, the high-pressure refrigerant compressed in the compressor 100 is introduced into a condensing space 230 corresponding to the internal space of the condenser 200 through a condenser connection channel 150. In addition, a cooling water channel 210 through which the cooling water introduced from the cooling water unit 600 can flow is included inside the condensing space 230. The condenser 200 includes a condensation chamber 201 having the condensation space 230 therein.

The cooling water channel 210 includes a cooling water inflow channel 211 through which the cooling water is introduced from the cooling water unit 600 and a cooling water discharge channel 212 through which the cooling water is discharged to the cooling water unit 600. The cooling water introduced into the cooling water inlet channel 211 exchanges heat with the refrigerant inside the condensing space 230, then passes through a cooling water connection channel 240 provided at one end inside or outside the condenser 200, and is introduced to the cooling water discharge channel 212.

The cooling water unit 600 and the condenser 200 are coupled to each other via a cooling water tube 220. The cooling water tube 220 may be made of a material such as rubber to not only serve as a passage through which the cooling water flows between the cooling water unit 600 and the condenser 200 but also to prevent the cooling water from leaking to the outside.

The cooling water tube 220 includes a cooling water inflow pipe 221 coupled to the cooling water inlet channel 211 and a cooling water discharge tube 222 coupled to the cooling water discharge channel 212. Looking at the flow of the cooling water as a whole, the cooling water after heat exchange with air or liquid in the cooling water unit 600 is introduced into the condenser 200 through the cooling water inflow pipe 221. The cooling water introduced into the condenser 200 exchanges heat with the refrigerant introduced into the condenser 200 while subsequentially passing through the cooling water inlet channel 211, the cooling water connection channel 240, and the cooling water discharge channel 212 provided in the condenser 200, and then, passes through the cooling water unit 600 again and is introduced into the cooling water unit 600.

Meanwhile, the cooling water that has absorbed heat of the refrigerant through heat exchange in the condenser 200 may be air-cooled in the cooling water unit 600. The cooling water unit 600 includes a main body 630, a cooling water inflow pipe 610 that is an inlet through which the cooling water that has absorbed heat through the cooling water discharge pipe 222 is introduced, and a cooling water discharge pipe 620 that is an outlet through which the cooling water cooled inside the cooling water unit 600 is discharged.

The cooling water unit 600 may use air to cool the cooling water introduced into the main body 630. Specifically, the main body 630 includes a fan that generates a flow of air, an air discharge port 631 through which the air is discharged, and an air inlet port 632 corresponding to an inlet through which air is introduced into the main body 630.

The air discharged after the heat exchange at the air discharge port 631 may be used for heating. The refrigerant after heat exchange in the condenser 200 is condensed and collected in a lower portion of the condensing space 230. The collected refrigerant is introduced into a refrigerant box 250 provided in the condensing space 230 and then flows into the expander 300.

The refrigerant box 250 is introduced into a refrigerant inlet 251, and the introduced refrigerant is discharged through an evaporator connection channel 260. The evaporator connection channel 260 includes an evaporator connection channel inlet 261, and the evaporator connection channel inlet 261 may be located below the refrigerant box 250.

The evaporator 400 includes an evaporation chamber 401 having an evaporation space 430 in which the heat exchange is generated between the refrigerant expanded in the expander 300 and the cold water. The refrigerant passing through the expander 300 in the evaporator connection channel 260 is coupled to a refrigerant injection device 450 provided in the evaporator 400, and passes through a refrigerant injection hole 451 provided in the refrigerant injection device 450 to be spread evenly into the evaporator 400.

In addition, a cold water channel 410 is provided inside the evaporator 400 and the cold water channel includes a cold water inflow channel 411 through which the cold water is introduced into the evaporator 400 and a cold water discharge channel 412 through which the cold water is discharged to the outside of the evaporator 400.

The cold water is introduced or discharged through a cold water tube 420 in communication with an air conditioning unit 500 provided outside the evaporator 400. The cold water tube 420 includes a cold water inflow tube 421 that is a passage through which the cold water inside the air conditioning unit 500 flows to the evaporator 400 and a cold water discharge tube 422 that is a passage through which the cold water that have performed the heat exchange in the evaporator 400 flows to the air conditioning unit 500. That is, the cold water inflow tube 421 communicates with the cold water inlet channel 411, and the cold water discharge tube 422 communicates with the cold water discharge channel 412.

Looking at the flow of cold water, the cold water passes through a cold water connection channel 440 provided at an one end inside the evaporator 400 or outside the evaporator 400 through the air conditioning unit 500, the cold water inflow tube 421, and the cold water inlet channel 411), and then, is introduced into the air conditioning unit 500 again through the discharge channel 412 and the cold water discharge tube 422.

The air conditioning unit 500 cools the cold water through the refrigerant. The cooled cold water absorbs heat from the air in the air conditioning unit 500 to enable indoor cooling. The air conditioning unit 500 includes a cold water discharge pipe 520 communicating with the cold water inflow tube 421 and a cold water inflow pipe 510 communicating with the cold water discharge tube 422. The refrigerant that has performed the heat exchange in the evaporator 400 is introduced into the compressor 100 again through the compressor connection channel 460.

Figure 2:
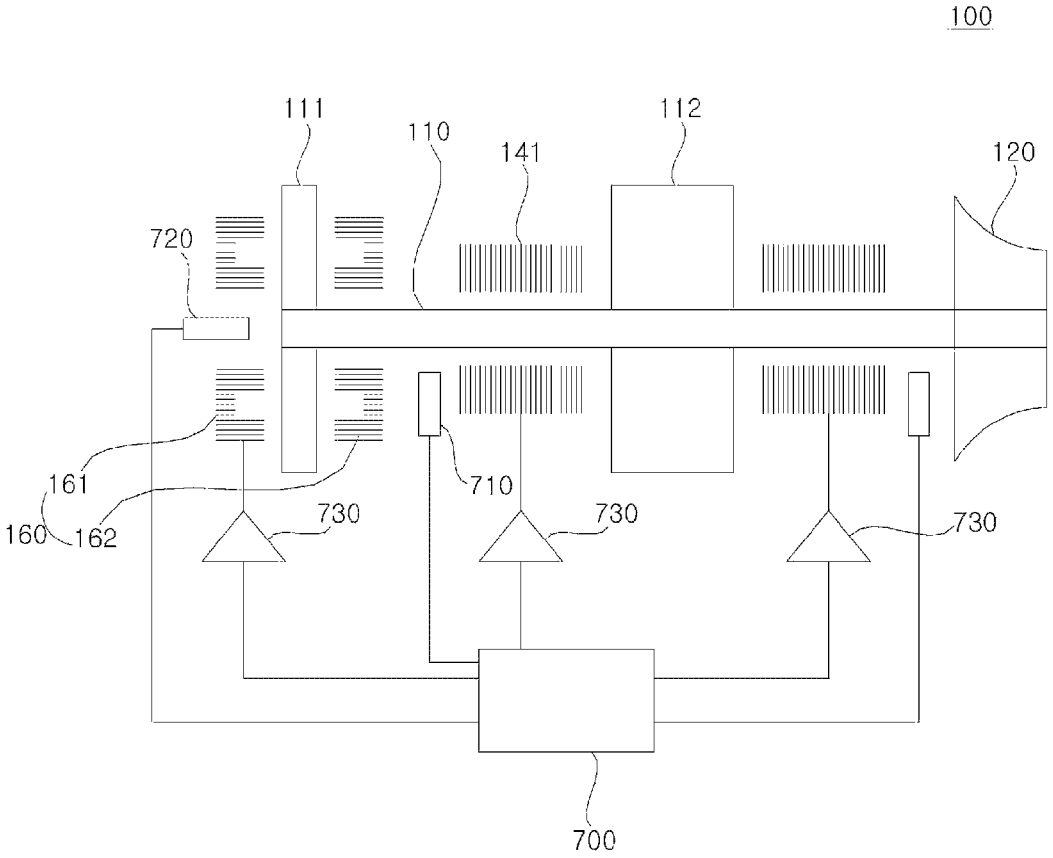
FIG. 2 illustrates a structure of a compressor according to one embodiment of the present disclosure.
Figure 3:
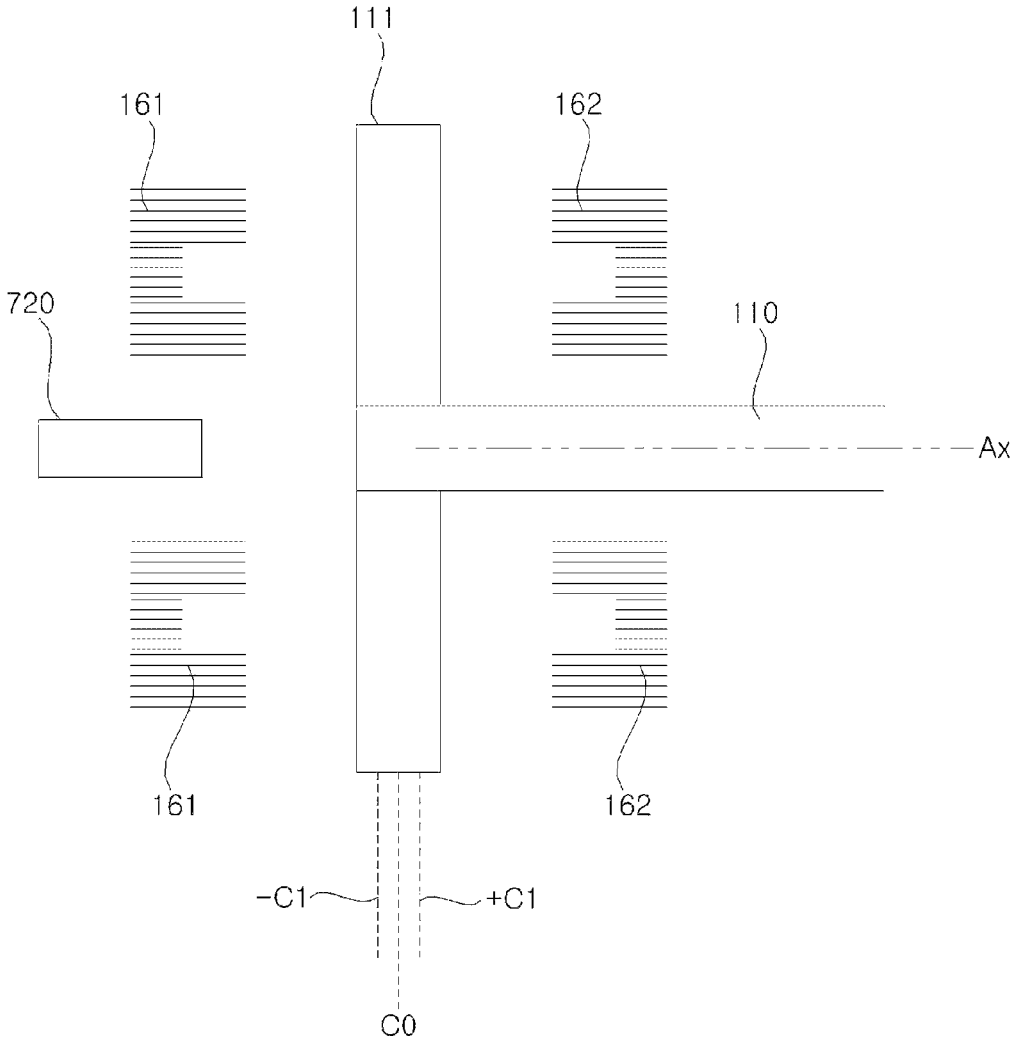
FIG. 3 is a diagram illustrating a case in which a surge does not occur in the compressor according to one embodiment of the present disclosure.
Figure 4:
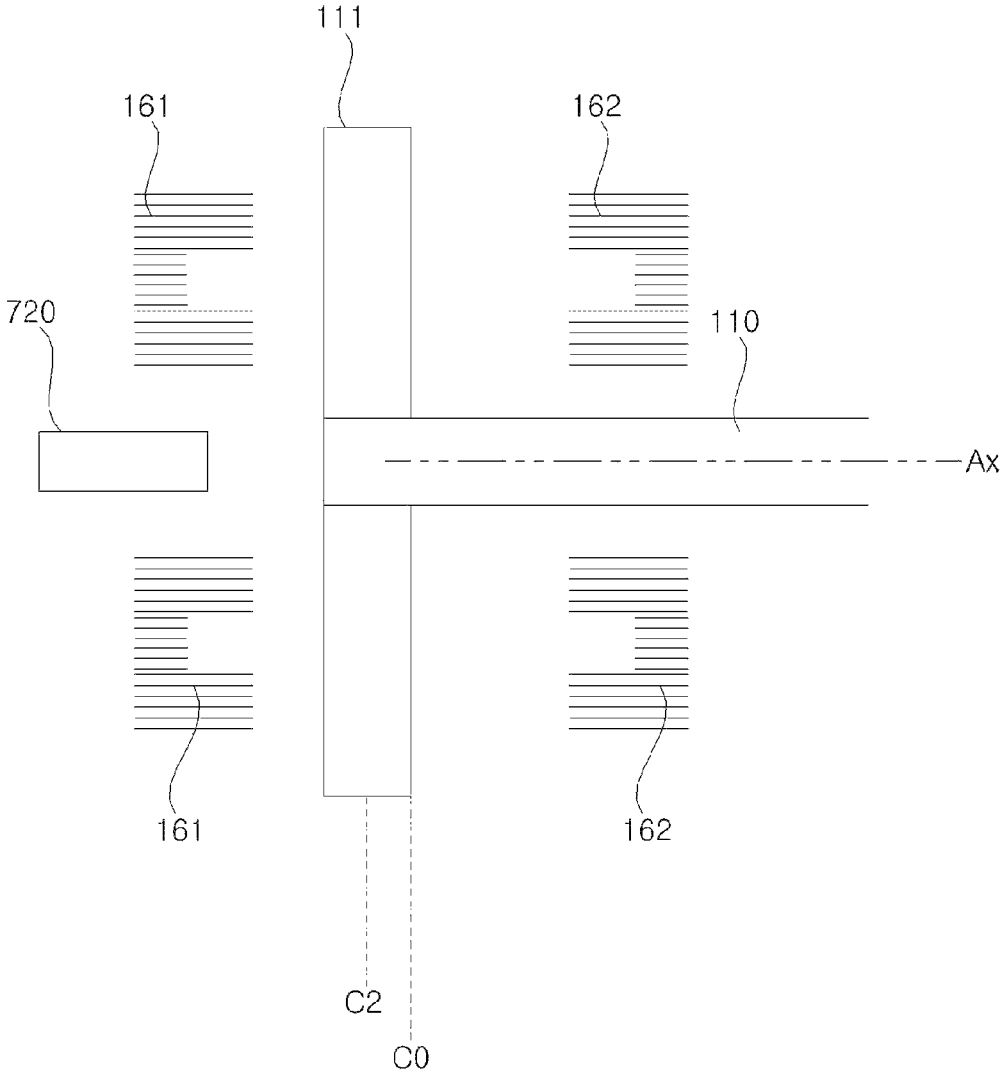
FIG. 4 is a diagram illustrating a case in which the compressor according to one embodiment of the present disclosure is subjected to a surge generation condition.

FIG. 2 illustrates a centrifugal compressor 100 (turbo-compressor) according to one embodiment of the present disclosure.

The compressor 100 according to FIG. 2 is one or more impellers 120 which suctions a refrigerant in an axial direction Ax and compress the refrigerant in a centrifugal direction, a rotating shaft 110 to which the impeller 120 and a motor rotating the impeller 120 are coupled, a bearing portion 140 which includes a plurality of magnetic bearings 141 rotatably supporting the rotating shaft 110 in air and a bearing housing 142 supporting the magnetic bearing 141, a gap sensor 70 which detects a distance from the rotating shaft 110, and a thrust bearing 160 which restricts vibrations of the rotating shaft 110 in the axial direction Ax.

In general, the impeller 120 includes one stage or two stages, and may include a plurality of stages. The impeller 120 is rotated by the rotating shaft 110 and increases the pressure of the refrigerant by compressing the refrigerant introduced in the axial direction Ax by rotation in the centrifugal direction.

The motor 130 has a rotating shaft 110 separated from the rotating shaft 110 and may have a structure for transmitting a rotational force to the rotating shaft 110 by a belt (not illustrated). However, in the case of one embodiment of the present disclosure, the motor 13 includes a stator (not illustrated) and a rotor 112 to rotate the rotating shaft 110.

The rotating shaft 110 is connected to the impeller 120 and the motor 13. The rotating shaft 110 extends in a left-right direction of FIG. 2. Hereinafter, the axial direction Ax of the rotating shaft 110 means the left-right direction. The rotating shaft 110 preferably includes a metal so as to be movable by magnetic force of the magnetic bearing 141 and the thrust bearing.

In order to prevent the rotating shaft 110 from being vibrated in the axial direction Ax (left-right direction) by the thrust bearing 160, it is preferable that the rotating shaft 110 has a constant area in a surface perpendicular to the axial direction Ax. Specifically, the rotating shaft 110 may further include a rotating shaft blade 111 that provides sufficient magnetic force to move the rotating shaft 110 by the magnetic force of the thrust bearing 160. The rotating shaft blade 111 may have a larger area than a cross-sectional area of the rotating shaft 110 in a surface perpendicular to the axial direction Ax. The rotating shaft blade 111 may be formed to extend in the rotational radial direction of the rotating shaft 110.

The magnetic bearing 141 and the thrust bearing 160 are made of a conductor, and a coil 143 is wound thereon. A current flowing in the wound coil 143 acts like a magnet.

A plurality of magnetic bearings 141 are provided to surround the rotating shaft 110 with the rotating shaft 110 as a center, and the thrust bearing 160 is provided to be adjacent to the rotating shaft blade 111 provided to extend in a rotational radial direction of the rotating shaft 110.

The magnetic bearing 141 allows the rotating shaft 110 to rotate without friction in a state floated in the air. To this end, at least three magnetic bearings 141 should be provided around the rotating shaft 110, and each magnetic bearing 141 should be installed in a balanced manner around the rotating shaft 110.

In the case of one embodiment of the present disclosure, four magnetic bearings 141 are provided to be symmetrical about the rotating shaft 110, and the rotating shaft 110 is floated in the air by the magnetic force generated by the coil wound on each magnetic bearing 141. As the rotating shaft 110 is floated in the air and rotated, energy lost due to friction is reduced, unlike the invention of the related art in which the existing bearing is provided.

Meanwhile, the compressor 100 may further include the bearing housing 142 supporting the magnetic bearing 141. A plurality of magnetic bearings 141 are provided, and are installed with a gap so as not to contact the rotating shaft 110.

The plurality of magnetic bearings 141 are installed at least at two points of the rotating shaft 110. The two points correspond to different points along a longitudinal direction of the rotating shaft 110. Since the rotating shaft 110 is straightly formed, it is necessary to support the rotating shaft 110 at least two points to prevent vibration in the circumferential direction.

Looking at the flow of the refrigerant, the refrigerant introduced into the compressor 100 through the compressor 100 connection channel 460 is compressed in the circumferential direction by the action of the impeller 120 and then discharged to the condenser connection channel 150. The compressor 100 connection channel 460 is coupled to the compressor 100 so that the refrigerant is introduced in a direction perpendicular to the rotation direction of the impeller 120.

The thrust bearing 160 limits the vibration of the rotating shaft 110 in the axial direction Ax vibration, and when the surge occurs, the thrust bearing 160 prevents the rotating shaft 110 from moving in the direction of the impeller 120 and colliding with other configurations of the compressor 100.

Specifically, the thrust bearing 160 includes a first thrust bearing 161 and a second thrust bearing 162, and is disposed to surround the rotating shaft blade 111 in the axial direction Ax of the rotating shaft 110. That is, the first thrust bearing 161, the rotating shaft blade 111, and the second thrust bearing 162 are sequentially disposed in the axial direction Ax of the rotating shaft 110.

More specifically, the second thrust bearing 162 is located closer to the impeller 120 than the first thrust bearing 161, the first thrust bearing 161 is farther from the impeller 120 than the second thrust bearing 161, and at least a portion of the rotating shaft 110 is located between the first thrust bearing 161 and the second thrust bearing 162. Preferably, the rotating shaft blade 111 is located between the first thrust bearing 161 and the second thrust bearing 162.

Therefore, it is possible to minimize the vibration of the rotating shaft 110 in the direction of the rotating shaft 110 by a magnetic force generated between the first thrust bearing 161 and the second thrust bearing 162 and the rotating shaft blade 111 having a large area.

The gap sensor 70 measures the movement of the rotating shaft 110 in the axial direction Ax (left-right direction). Of course, the gap sensor 70 may measure a movement of the rotating shaft 110 in a vertical direction (direction orthogonal to the axial direction Ax). Moreover, the gap sensor 70 may include a plurality of gap sensors 70.

For example, the gap sensor 70 includes a first gap sensor 710 that measures an up-down movement of the rotating shaft 110 and a second gap sensor 720 that measures a left-right movement of the rotating shaft 110. The second gap sensor 720 may be disposed to be spaced apart from one end in the axial direction Ax of the rotating shaft 110 in the axial direction Ax.

A force of the thrust bearing 160 is inversely proportional to square of a distance and proportional to square of a current. When the surge occurs in the rotating shaft 110, thrust is generated in the direction (right direction) of the impeller 120. The force generated in the right direction should be pulled with a maximum force using a magnetic force of the thrust bearing 160. However, the position of the rotating shaft 110 is located in a middle (reference position C0) of the two thrust bearings 160, it is difficult to quickly move the rotating shaft 110 to the reference position C0 in response to the rapid axis movement.

Since a force of thrust in the direction of the impeller 120 generated on the rotating shaft 110 is quite strong, when it is located at the reference position C0, there is a problem that it is necessary to increase the amount of current supplied to increase the magnetic force of the thrust bearing 160 or to increase a size of the thrust bearing 160.

Therefore, in the present disclosure, when the surge is expected to occur, the rotating shaft 110 is located in advance to be eccentric in a direction opposite to a direction in which the thrust is generated.

Specifically, a control unit 700 determines a surge generation condition based on the information received from the gap sensor 70. The control unit 700 may determine a condition as a surge generation condition when the position of the rotating shaft 110 measured by the gap sensor 70 is out of the normal position range (−C1 to +C1). In addition, when the position of the rotating shaft 110 measured by the gap sensor 70 is located within the normal position range (−C1 to +C1), the control unit 700 may determine a condition as a surge non-generation condition.

Here, the normal position range (−C1 to +C1) of the rotating shaft 110 means an area within a predetermined distance in the left-right direction based on the reference position C0 of the rotating shaft 110. The normal position range (−C1 to +C1) of the rotating shaft 110 means a range in which the vibration is in a normal state in a case where the rotating shaft 110 vibrates in the axial direction Ax by various environmental and peripheral factors when the rotating shaft 110 rotates. This normal position range (−C1 to +C1) is an experimental value, and the value of the normal position range (−C1 to +C1) may be determined based on the kurtosis or skewness of the position of the rotating shaft 110. There is no limit to a method of determining the normal position range (−C1 to +C1).

When the surge generation condition is satisfied, the control unit 700 adjusts the amount of current supplied to the thrust bearings 160 so that the rotating shaft 110 may be located to be eccentric in the direction opposite to the impeller 120 from the reference position C0. The position at which the rotating shaft 110 is eccentric means that the rotating shaft blade 111 is located between the first thrust bearing 160 and the reference position C0.

Therefore, when the surge occurs, the rotating shaft 110 may have a buffer time to rapidly move in the direction of the impeller 120, and the rotating shaft 110 may be easily controlled to move the normal position range (−C1 to +C1) due to an increase in the small amount of current.

Specifically, when the surge generation condition is satisfied, the control unit 700 may supply current only to the first thrust bearing 161 of the first and second thrust bearings 162. As another example, when the surge generation condition is satisfied, the control unit 700 may control the amount of current supplied to the first thrust bearing 161 to be greater than the amount of current supplied to the second thrust bearing 162.

After the surge generating condition is satisfied and the rotating shaft 110 is eccentric in the direction opposite to the impeller 120, the control unit 700 controls the rotating shaft 110 so that the position of the rotating shaft 110 is fixed at the eccentric position for a certain period of time. That is, when the surge occurs after the rotating shaft 110 is eccentric in the opposite direction to the impeller 120, the control unit 700 may increase the amount of current supplied to the first thrust bearing 161. After the rotating shaft 110 is eccentric in the opposite direction to the impeller 120, when a vibration width is maintained below a certain standard based on the eccentric position, the control unit 700 may move the rotating shaft 110 to the reference position C0 again.

When the surge non-generation condition is satisfied, the control unit 700 may adjust the amount of current supplied to the first thrust bearing 161 and the amount of current supplied to the second thrust bearing 162 to be the same. Alternatively, when the surge non-generation condition is satisfied, the control unit 700 adjusts the amounts of current supplied to the first thrust bearing 161 and the second thrust bearing 162 so that the rotating shaft 110 is located at the reference position C0.

A heat exchanger for a chiller of the present disclosure may include a case having a heat exchange space, a first refrigerant supply pipe coupled to the case and configured to supply a first refrigerant to the heat exchange space, a first refrigerant discharge pipe coupled to the case so that the first refrigerant in the heat exchange space is discharged through the first refrigerant discharge pipe, and a plurality of heat transfer pipes disposed in the heat exchange space of the case so that a second refrigerant exchanging heat with the first refrigerant flows through the heat transfer pipes.

The heat exchanger for a chiller may include the above-described evaporator and/or condenser. For example, the heat exchanger for a chiller may include a case having a heat exchange space, a first refrigerant supply pipe coupled to the case and configured to supply a first refrigerant to the heat exchange space, a first refrigerant discharge pipe coupled to the case so that the first refrigerant in the heat exchange space is discharged through the first refrigerant discharge pipe, and a plurality of heat transfer pipes disposed in the heat exchange space of the case so that a second refrigerant exchanging heat with the first refrigerant flows through the heat transfer pipes.

When the heat exchanger for a chiller is a condenser, the case may be the condensation chamber 201, the first refrigerant supply pipe may be the condenser connection channel 150, the first refrigerant discharge pipe may be the evaporator connection channel 260, and the heat transfer pipe may be the cooling water inflow channel 211 and/or the cooling water discharge channel 212.

When the heat exchanger for a chiller is the evaporator, the case may be the evaporation chamber 401, the first refrigerant supply pipe may be the evaporator connection channel 260, the first refrigerant discharge pipe may be the compressor connection channel 460, the heat transfer pipe may be the cold water inflow channel 411 and/or the cold water discharge channel 412, or at least a portion of the cold water inlet channel 411 and/or the cold water discharge channel 412.

Here, the first refrigerant may be water, and the second refrigerant may be any one of Freon, R-134a, and R1233zd.

Such a general heat pipe has a problem in that when a fluid passes into the inside of the heat transfer pipe, the fluid, which is a liquid or gas, passes quickly without contacting 100% or more of an inner surface of the heat transfer pipe evenly, and thus, the transfer with the external second refrigerant is reduced.

In addition, since the fluid moves at a constant speed without interference of an obstacle when the fluid passes through the heat transfer pipe, the fluid moves in a state where heat transfer of the fluid is not completely achieved with the surface. Accordingly, sufficient heat exchange is not achieved, and when the fluid moves, a portion of the fluid passes through the inside of the heat transfer pipe as it is without generating a flow, and thus, the heat of the fluid cannot be effectively transferred.

In particular, when R-134a, which is a refrigerant for the existing chiller, is changed to R1233zd, which is an eco-friendly refrigerant (non-flammable, non-toxic), there is a problem that the performance of the heat transfer pipe is greatly reduced (40%).

Therefore, the heat transfer pipe of the present disclosure solves the above-described problems, has excellent efficiency, and has a configuration that can use an eco-friendly refrigerant.

Hereinafter, the heat transfer pipe of the present disclosure will be described in detail.

Figure 5:
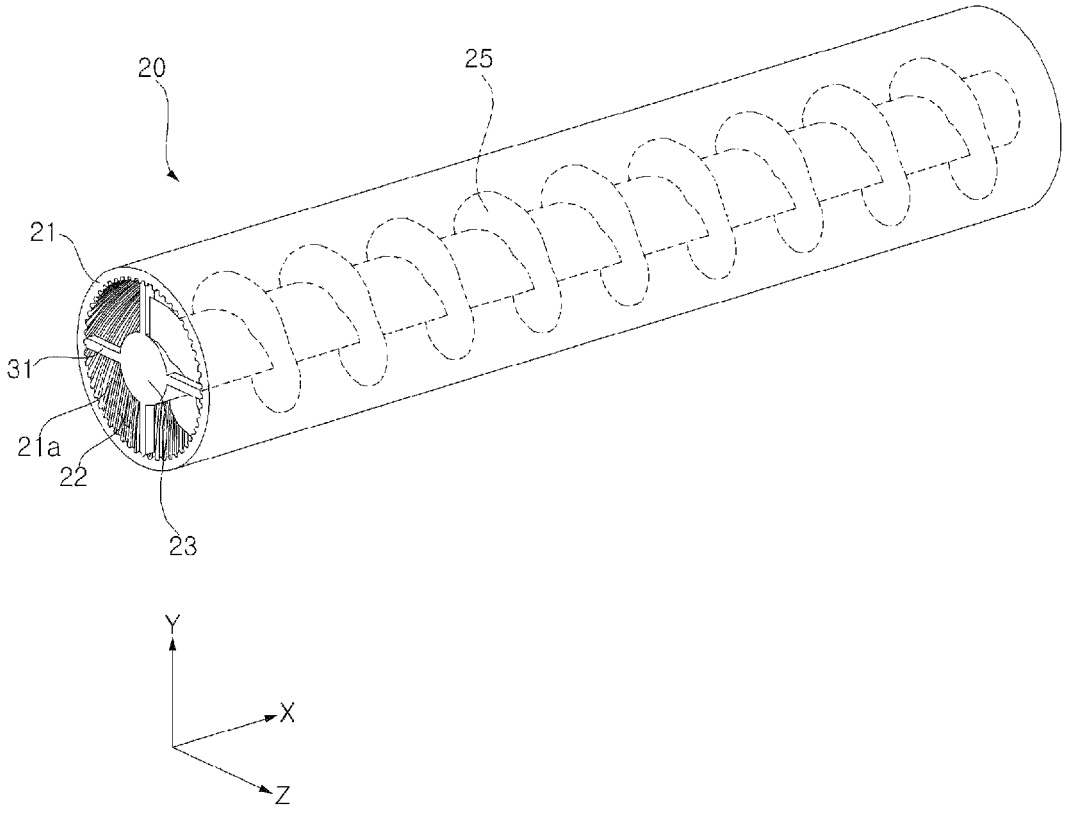
FIG. 5 is a perspective view of a heat transfer pipe according to one embodiment of the present disclosure.
Figure 6:
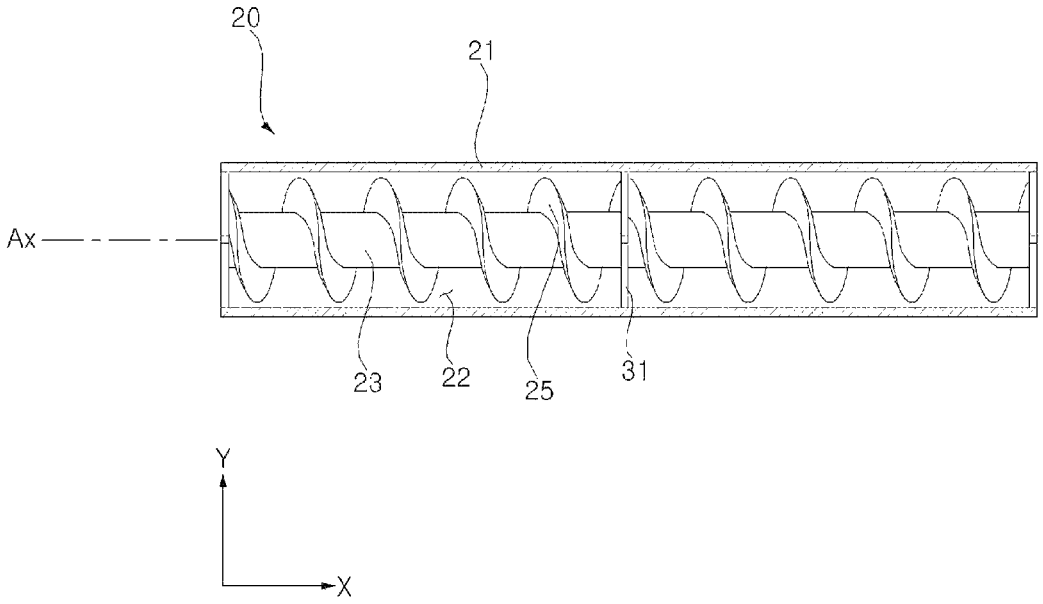
FIG. 6 is a view illustrating an inside of the heat transfer pipe of FIG. 5.
Figure 7:
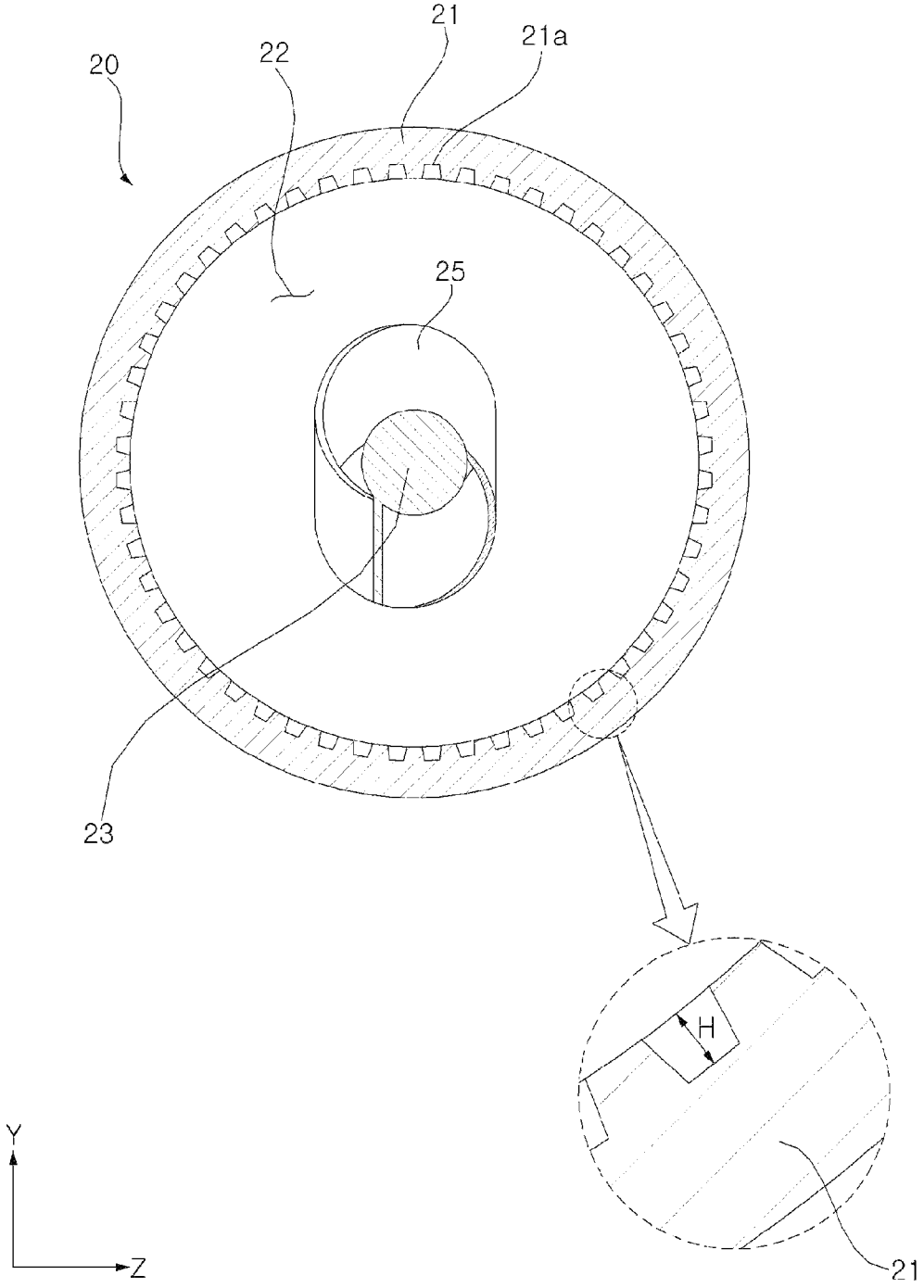
FIG. 7 is a cross-sectional view of the heat transfer pipe of FIG. 5.
Figure 8:
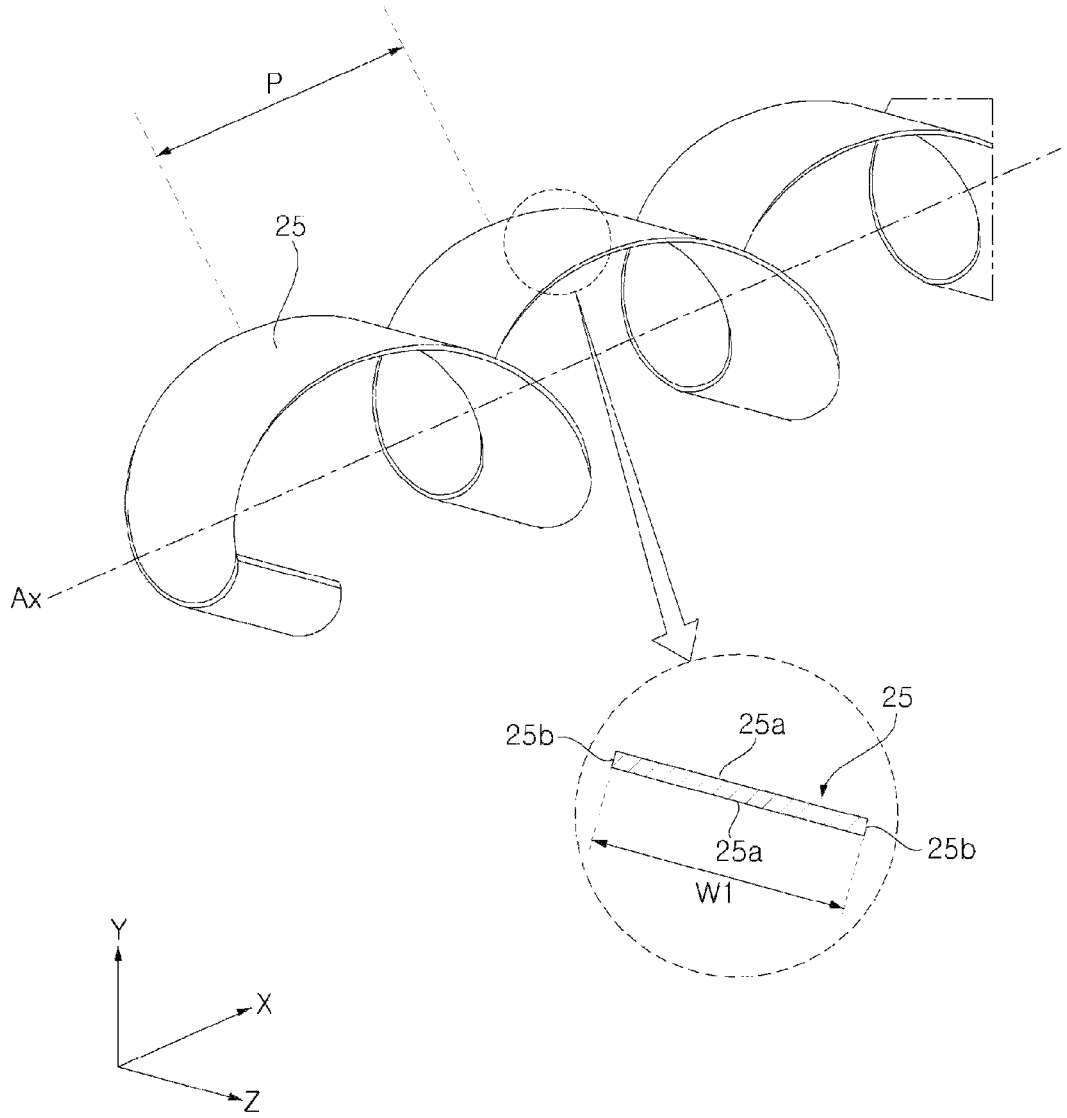
FIG. 8 is a perspective view and a cross-sectional view of a resistor according to one embodiment of the present disclosure.

FIG. 5 is a perspective view of a heat transfer pipe according to one embodiment of the present disclosure, FIG. 6 is a view illustrating an inside of the heat transfer pipe of FIG. 5, FIG. 7 is a cross-sectional view of the heat transfer pipe of FIG. 5, and FIG. 8 is a perspective view and a cross-sectional view of a resistor 25 according to one embodiment of the present disclosure.

Referring to FIGS. 5 to 8, the heat transfer pipe of the present disclosure includes an outer pipe 21 that has a space therein and extends a first direction, a core 23 that is disposed in the space inside the outer pipe, defines a refrigerant flow space 22 through which a refrigerant flows between an inner surface of the outer pipe 21 and the core, and extends in the first direction, and a resistor 25 that is disposed in the refrigerant flow space 22 and has a spiral shape with a central axis Al disposed to be parallel to the first direction.

The outer pipe 21 has the space therein and extends in the first direction. Here, the first direction is an X-axis direction, and the second refrigerant flows in the first direction. The outer pipe 21 is made of a metal material having high thermal conductivity. The outer pipe 21 assists heat exchange between the second refrigerant flowing inside and the first refrigerant flowing outside.

A multi-faceted shape (based on FIG. 5, hereinafter the cross-sectional shape is based on the X-Y axis cross-section) of the outer pipe 21 may be a circular or elliptical polygon having the refrigerant flow space 22 therein. Preferably, the outer pipe 21 is circular with a large outer surface area.

A diameter of the outer pipe 21 is not limited. However, when the outer pipe 21 is too large, heat exchange efficiency is reduced, and when the outer pipe 21 is too small, a heat exchange time takes a long time. Accordingly, the diameter of the outer pipe 21 may be 17 mm to 25 mm. The diameter of the outer pipe 21 is preferably 19 to 21 mm.

The outer pipe 21 may have a plurality of grooves or protrusions to increase a surface area. For example, a plurality of guide grooves 21*a* may be formed on the inner surface of the outer pipe 21. The guide groove 21*a* is formed so that the inner surface of the outer pipe 21 is recessed to the outside.

The plurality of guide grooves 21*a* may be regularly or irregularly formed on the inner surface of the outer pipe 21. The plurality of guide grooves 21*a* improve a contact area between the second refrigerant and the inner surface of the outer pipe 21.

When a depth of the guide groove 21*a* is too large, a thickness of the outer pipe 21 is increased, and when the depth of the guide groove 21 is too small, the surface area cannot be improved. Therefore, a depth H of the guide groove 21*a* is preferably 1% to 4% of the diameter of the outer pipe 21.

In addition, the guide groove 21*a* may be configured as one continuous groove. Specifically, the guide groove 21*a* may have an inner surface recessed in the outer pipe 21, and may have a spiral shape in which the central axis A1 is arranged parallel to the first direction. That is, the guide groove 21*a* may have a shape that advances in the first direction while turning around the central axis A1 disposed in parallel to the first direction. In other words, the guide groove 21*a* may have a shape that advances in the first direction while rotating clockwise when viewed from the first direction.

The core 23 is disposed in the inner space of the outer pipe 21. the refrigerant flow space 22 through which the refrigerant flows is defined between the outer surface of the core 23 and the inner surface of the outer pipe 21. The inside of the core 23 is a space in which the second refrigerant does not flow, and may be an empty space or may be filled with a material.

The core 23 extends in the first direction and has the same or similar length as the outer pipe 21. The core 23 may be disposed eccentrically from an inner center of the outer pipe 21 to one side. However, the core 23 may be disposed at the center of the outer pipe 21 in order to solve the arrangement of the resistor 25 and the problem that the refrigerant passing through the center of the outer pipe 21 hardly exchanges heat with the external refrigerant. Specifically, the center of the core 23 may coincide with the center of the outer pipe 21. The core 23 may extend in the first direction and may be disposed in parallel to the outer pipe 21.

A cross-sectional shape of the core 23 is not limited, but may be a shape having a constant area on the cross-section of FIG. 7. The cross-sectional shape of the core 23 is preferably circular. Since the refrigerant efficiency of the refrigerant passing from the center to the circular space in the outer pipe 21 is extremely low, when the cross-sectional shape of the core 23 is circular, it does not significantly limit the flow space of the refrigerant and helps to improve the efficiency. In the case of the core 23, when the same flow rate flows, the core 23 serves to reduce the flow cross-sectional area, thereby increasing the flow rate and increasing the amount of heat.

When a size of the core 23 is too small, there is no increase in heat exchange efficiency, and when the size is too large, a pressure loss of the refrigerant in the outer pipe 21 becomes too large. Accordingly, the diameter of the core 23 is preferably 15% to 50% of the diameter of the outer pipe 21.

The core 23 can be located within the outer pipe 21 by arms 31. Each of the arms 31 positions the core 23 in the space inside the outer pipe 21 and fixes the position of the arm 31. The arm 31 couples the core 23 to the outer pipe 21. The arm 31 couples the outer surface of the core 23 to the inner surface of the outer pipe 21. A plurality of arms 31 may be arranged to be spaced apart from each other in the first direction.

The resistor 25 applies resistance to the refrigerant flowing in the refrigerant flow space 22 and generates a turbulent flow and/or a vortex. The resistor 25 may be disposed to surround the core 23. For example, the resistor 25 may have a spiral shape in which the central axis A1 is arranged parallel to the first direction as illustrated in FIG. 8.

The resistor 25 has a spiral shape (which gradually moves away from the central axis A1 at one end) that advances along the central axis A1 (the first direction) while turning around the central axis A1 (the core 23). The core 23 may be disposed inside the spiral of the resistor 25.

The central axis A1 of the spiral of the resistor 25 may be disposed to overlap the core 23. It is preferable that the central axis A1 of the spiral of the resistor 25 coincides with the central axis A1 of the core 23. One end of the resistor 25 may be couped to the outer surface of the core 23 or may be coupled to the inner surface of the outer pipe 21. In addition, the resistor 25 may be spaced apart from the core 23 and the outer pipe 21 and supported by a supporter (not illustrated).

When a pitch of the spiral of the resistor 25 is too small or too large, it is difficult to form the vortex or turbulence. Accordingly, preferably, a pitch P of the spiral of the resistor 25 is 50% to 150% of the diameter of the outer pipe 21.

The cross-section of the resistor 25 may include at least one of a circle, an ellipse, and a polygon. When the cross-section of the resistor 25 is elliptical or polygonal, the resistor 25 may have a shape twisted in the longitudinal direction.

Specifically, the cross section of the resistor 25 may be a rectangle including a long side 25*a* and a short side 25*b*. A length W1 of the long side 25*a* is preferably 10% to 50% of the diameter of the outer pipe 21. This is because when the length of the long side 25*a* is too small or too large, vortex and turbulence cannot be formed.

The resistor 25 promotes the vortex and turbulence of the refrigerant passing through the refrigerant flow space 22, the core 23 eliminates a region where heat exchange hardly occurs in the refrigerant flow space 22 and increases the flow rate of the refrigerant, and thus, heat exchange efficiency is improved.

Figure 9:
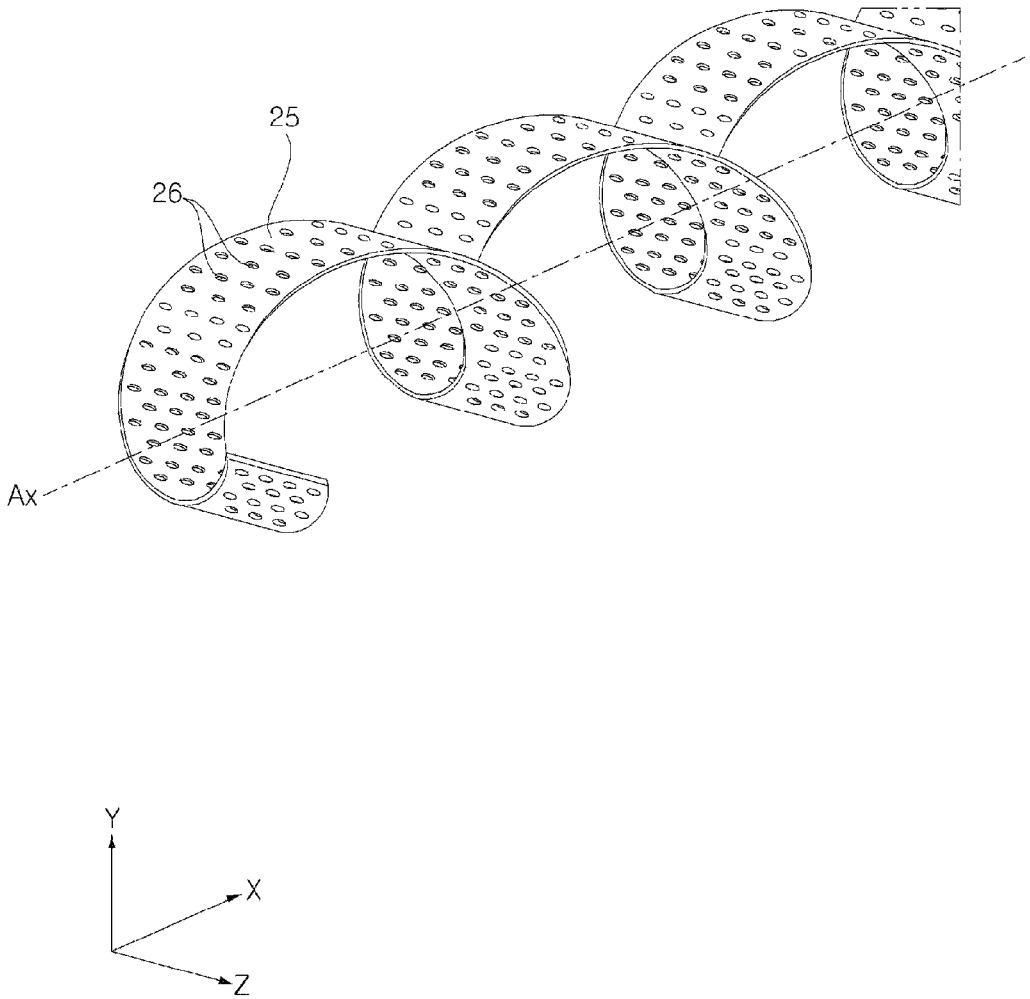
FIG. 9 is a perspective view of a resistor according to another embodiment of the present disclosure.

FIG. 9 is a perspective view of a resistor 25 according to another embodiment of the present disclosure.

Referring to FIG. 9, the resistor 25 of another embodiment may further include a plurality of guide holes 26, compared with the embodiment of FIG. 8. Hereinafter, differences from the embodiment of FIG. 8 will be mainly described, and a description of the same configuration as the embodiment of FIG. 8 will be omitted.

The plurality of guide holes 26 are formed to pass through the resistor 25. The plurality of guide holes 26 promote vortex and turbulence again in the refrigerant in which vortex and turbulence are formed by the resistor 25. A portion of the refrigerant flows along the resistor 25 to generate the turbulence and vortex, and a portion of the refrigerant passes through the plurality of guide holes 26 to generate the turbulence and vortex.

When the cross section of the resistor 25 is rectangular, the plurality of guide holes 26 may be formed to pass through the long sides 25*a* facing each other. A diameter of each of the plurality of guide holes 26 is preferably 5% to 20% of the length of the long side 25*a*.

According to the present disclosure, the core is disposed at the center of the heat transfer pipe, and thus, it is possible to prevent the refrigerant passing through the center of the heat transfer pipe from not exchanging heat with the refrigerant outside the heat transfer pipe, and thus, it is possible to improve heat exchange efficiency.

According to the present disclosure, a speed of the refrigerant passing through the outer region inside the heat transfer pipe is reduced, and thus, the turbulence and vortex are generated. Therefore, it is possible to improve the heat exchange time and efficiency with the refrigerant outside the heat transfer pipe.

The present disclosure has a structure which is simple and easily manufactured.

According to the present disclosure, even when the eco-friendly refrigerant is used, it is possible to increase efficiency of the chiller.

Hereinbefore, preferred embodiments of the present disclosure are illustrated and described, but the present disclosure is not limited to the specific embodiments described above.

That is, various modifications can be made by a person with ordinary skill in the technical field to which the invention belongs without departing from the gist of the present disclosure described in claims, and these modified implementations should not be individually understood from a technical spirit or perspective of the present disclosure.

What is claimed is:

1. A heat exchanger for a chiller comprising:

a case having a heat exchange space;

a first refrigerant supply pipe coupled to the case and configured to supply a first refrigerant to the heat exchange space;

a first refrigerant discharge pipe coupled to the case so that the first refrigerant in the heat exchange space is discharged through the first refrigerant discharge pipe; and a plurality of heat transfer pipes disposed in the heat exchange space of the case so that a second refrigerant exchanging heat with the first refrigerant flows through the heat transfer pipes, wherein at least one of the heat transfer pipes includes:

an outer pipe having a space therein and extending in a first direction, a core disposed in an internal space of the outer pipe, defining a refrigerant flow space through which the refrigerant flows between an inner surface of the outer pipe and the core, and extending in the first direction, a resistor disposed in the refrigerant flow space and having a spiral shape advancing in the first direction while turning around the core, a plurality of guide holes passing through the resistor, a plurality of guide grooves formed on the inner surface of the outer pipe, and a plurality of arms coupling the core to the outer pipe, wherein the resistor has the spiral shape with a central axis disposed to be parallel to the first direction.

2. The heat exchanger for a chiller of claim 1, wherein the core is disposed at a center of the outer pipe.

3. The heat exchanger for a chiller of claim 1, wherein a cross-sectional shape of the core is a circular.

4. The heat exchanger for a chiller of claim 1, a central axis of a spiral of the resistor is disposed to overlap the core.

5. The heat exchanger for a chiller of claim 1, wherein a cross section of the resistor includes at least one of a circle, an ellipse, and a polygon.

6. The heat exchanger for a chiller of claim 1, a pitch of a spiral of the resistor is 50% to 150% of a diameter of the outer pipe.

7. The heat exchanger for a chiller of claim 1, wherein a cross section of the resistor is a rectangle having a long side and a short side, and a length of the long side is 10% to 50% of a diameter of the outer pipe.

* * * * *